US005101988A

United States Patent [19]

Meyer

[11] Patent Number: 5,101,988

[45] Date of Patent: Apr. 7, 1992

[54] MODULAR STORAGE TRAY ASSEMBLY

[75] Inventor: Cheryl A. Meyer, Denver, Colo.

[73] Assignee: Studio 1712, Inc., Denver, Colo.

[21] Appl. No.: 276,925

[22] Filed: Nov. 28, 1988

[51] Int. Cl.[5] ..... A47F 5/08

[52] U.S. Cl. ..... 211/88; 211/184; 211/194; 220/23.83

[58] Field of Search ..... 211/88, 113, 118, 35, 211/32, 55, 128, 187, 194, 189, 184; 220/23.4, 23.83, 4 C, 4 D

[56] References Cited

U.S. PATENT DOCUMENTS

| | | | |
|---|---|---|---|
| 2,206,588 | 7/1980 | Tritt | 211/32 X |
| 2,657,810 | 11/1953 | Garrick | 211/118 X |
| 3,207,321 | 9/1965 | Joyce | 211/126 |
| 3,515,283 | 6/1970 | Poteat | 211/55 |
| 3,606,949 | 9/1971 | Joyce | 211/126 |

*Primary Examiner*—Blair M. Johnson

[57] ABSTRACT

A modular storage tray assembly is attached to a wall by means of a headpiece with two pins spaced a predetermined horizontal distance apart. A number of tray assemblies are suspended in series from the headpiece by means of these pins. Each tray assembly has a horizontal tray, a connecting member adapted to removably attach to the pins of the headpiece or to the tray assembly immediately above, and a pair of pins on the edges of the tray to permit attachment of the next tray assembly below. The spacing between each pair of pins is substantially uniform, so that the tray assemblies can fastened together in any order. Removable dividers can be inserted to divide the trays into separate compartments. A frame with a number of forward-extending members can be added below the bottom tray assembly to hang necklaces, bracelets or rings.

2 Claims, 5 Drawing Sheets 10
20a
20b
20c
26
30
12
28
34
28
34
28
34
46
44
40
42

MODULAR STORAGE TRAY ASSEMBLY

BACKGROUND OF THE INVENTION

1. Field of the Invention

The present invention relates generally to the field of storage trays and bins used to hold small articles such as jewelry, and in particular to modular wall-mounted storage trays and bins.

2. Statement of the Problem

A prior art search conducted by the inventor of the present invention disclosed a variety of storage containers, trays, and racks having various functions, as follows:

| Inventor | U.S. Pat. No. | Issue Date |
|---|---|---|
| Fieldstein | 1,815,651 | 5/11/29 |
| Joyce | 3,581,906 | 6/1/71 |
| Presberg | 3,895,720 | 7/22/75 |
| Dean, et al. | 3,905,484 | 9/16/75 |
| Thompson | 4,008,872 | 2/22/77 |
| Hopkins, et al. | 4,350,252 | 9/21/82 |
| Norberg, et al. | 4,476,985 | 10/16/84 |
| Stenberg | 4,525,882 | 7/2/85 |
| Field | 4,552,272 | 11/12/85 |

U.S. Pat. No. 3,581,906 issued to Joyce discloses a storage bin that can be assembled with several such bins stacked on top of one another to form a vertically stacked array. A number of dividers can be inserted to define individualized compartments in each bin.

U.S. Pat. No. 4,008,872 issued to Thompson relates to a modular supporting system wherein a module 14 is selectively removable from a support 10. The details of the structure for the modular removal are shown in FIGS. 2 and 3.

U.S. Pat. No. 3,895,720 issued to Presberg relates to a rack for ticket sales. Presberg shows a modular unit that grows vertically as shown in FIG. 1 by elements 10*a*, 10*b*, and 10*c* that are engaged by tongue and groove joints. Each of the modular units has a wing member 14 for holding tickets. Hence, the user can selectively add vertical ticket holder members 14 by adding on additional members 10.

Similarly, U.S. Pat. No. 4,350,252 issued to Hopkins, et al., shows a display rack which is grooved to receive additional support racks. The specific structure is most clearly shown in FIG. 3.

The remaining patents to Norberg, et al., Field, Stenberg, Fieldstein, and Dean, et al., all show various embodiments for providing dividers for a compartmentalized display system.

3. Solution to the Problem

None of the prior art references uncovered in the search set forth the use of a modular storage tray assembly having a wall-attached element and a number of modular trays suspended therefrom in series down the wall. Each adjacent pair of modular elements is fastened together by means of a pair of pins on one of the elements that seat in a corresponding pair of holes or recessed indentations in the second element.

SUMMARY OF THE INVENTION

This invention provides a modular storage tray assembly having a wall attachment plate with two pins spaced a predetermined horizontal distance apart. A number of tray assemblies are suspended in series from the headpiece by means of these pins. Each tray assembly has a horizontal tray, a connecting member adapted to removably attach to the pins of the headpiece or to the tray assembly immediately above, and a pair of pins on the edges of the tray to permit attachment of the next tray assembly below. The spacing between each pair of pins is substantially uniform, so that the tray assemblies can fastened together in any order. Removable dividers can be inserted to divide each tray into separate compartments. A frame with a number of pegs can be added below the bottom tray assembly to hang necklaces, neckties or belts.

A primary object of the present invention is to provide a modular tray assembly for storing jewelry and other small items, that can be easily expanded as needed by suspending additional trays from the assembly.

Another object of the present invention is to provide a modular tray assembly that does not take up shelf space or counter space.

Yet another object of the present invention is to provide a modular tray assembly having an aesthetic appearance that can be inexpensively molded from conventional plastics.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
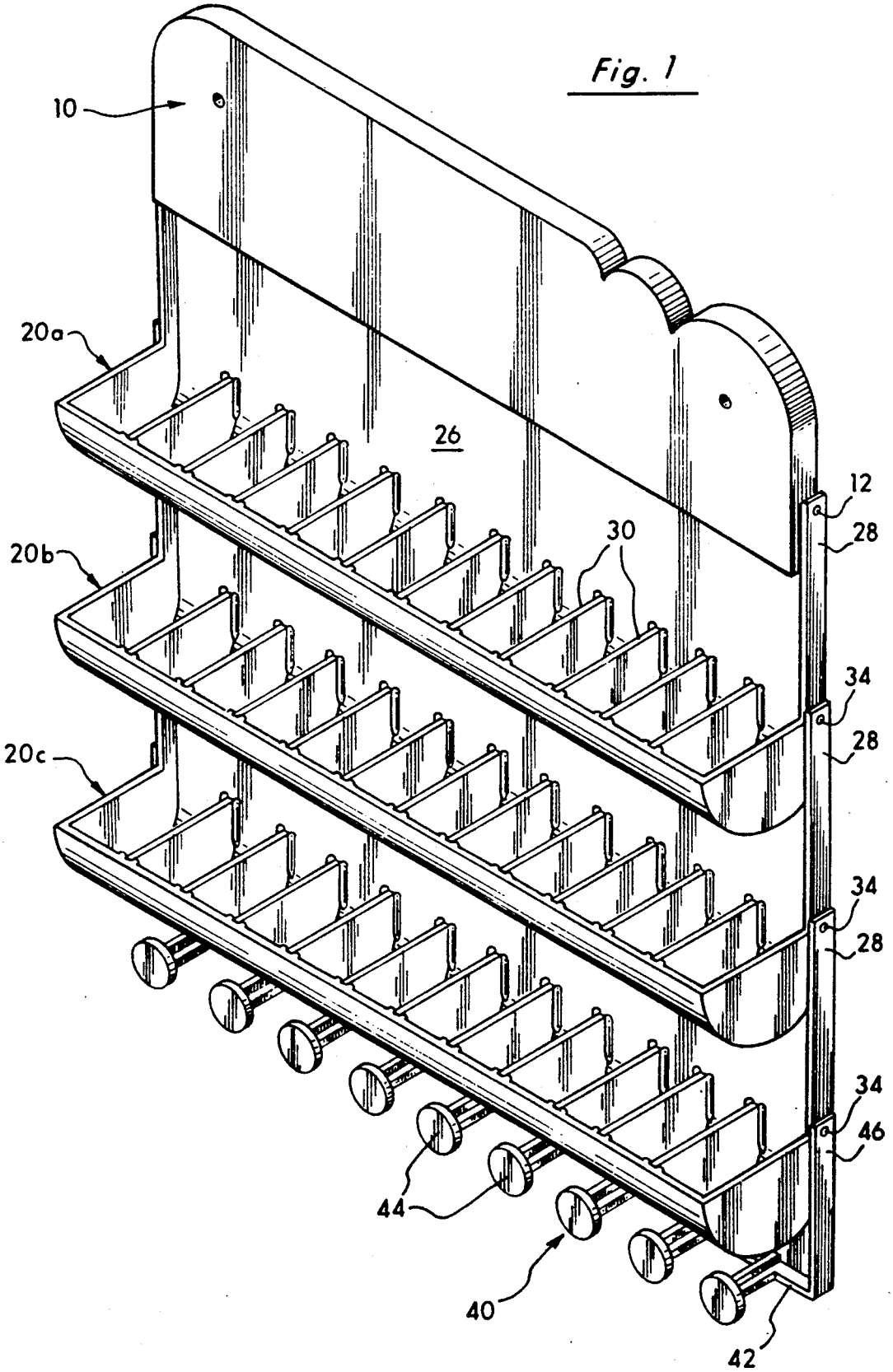
FIG. 1 is a perspective view of the assembled unit.
Figure 2:
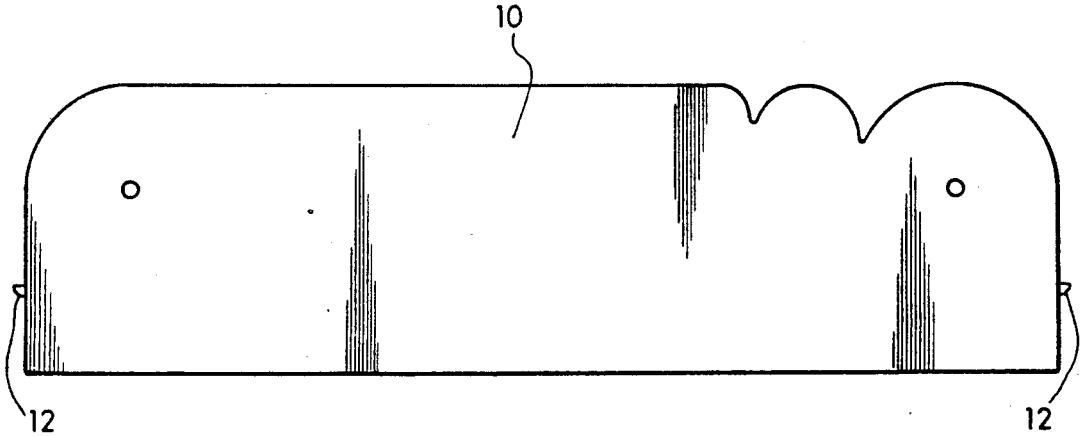
FIG. 2 is a front view of the headpiece used to mount the unit to a wall.

FIG. 1 shows a perspective view of the assembled unit which generally consists of a headpiece 10, a number of tray assemblies 20*a*, 20*b*, and 20*c* suspended in series from the headpiece, and optionally a hanger assembly 40 suspended below the bottom tray assembly. FIG. 2 shows the headpiece 10 in greater detail. The function of the headpiece is to secure the unit to a wall or other vertical surface. This can be accomplished by any number of conventional means of attachment, such as screws, nails, or adhesives. The shape of headpiece shown in the figures was selected solely for aesthetic reasons. The functional requirements of this element could be satisfied simply by anchoring two hooks or pins into the wall to provide vertical support for the initial tray assembly. The key features of the headpiece are the two pins 12 that removably attach to the holes or recessed indentations 32 (shown in FIG. 3) on the upper portion of the first tray assembly 20*a*. A similar pair of pins 34 on the lower portion of each tray assembly 20 are removably attached to the holes or recessed indentations on the upper portion of the next tray assembly below to suspend the components in series from the head piece. With a uniform horizontal spacing between each pair of pins, the tray assemblies can be interconnected in any order.

Figure 3:
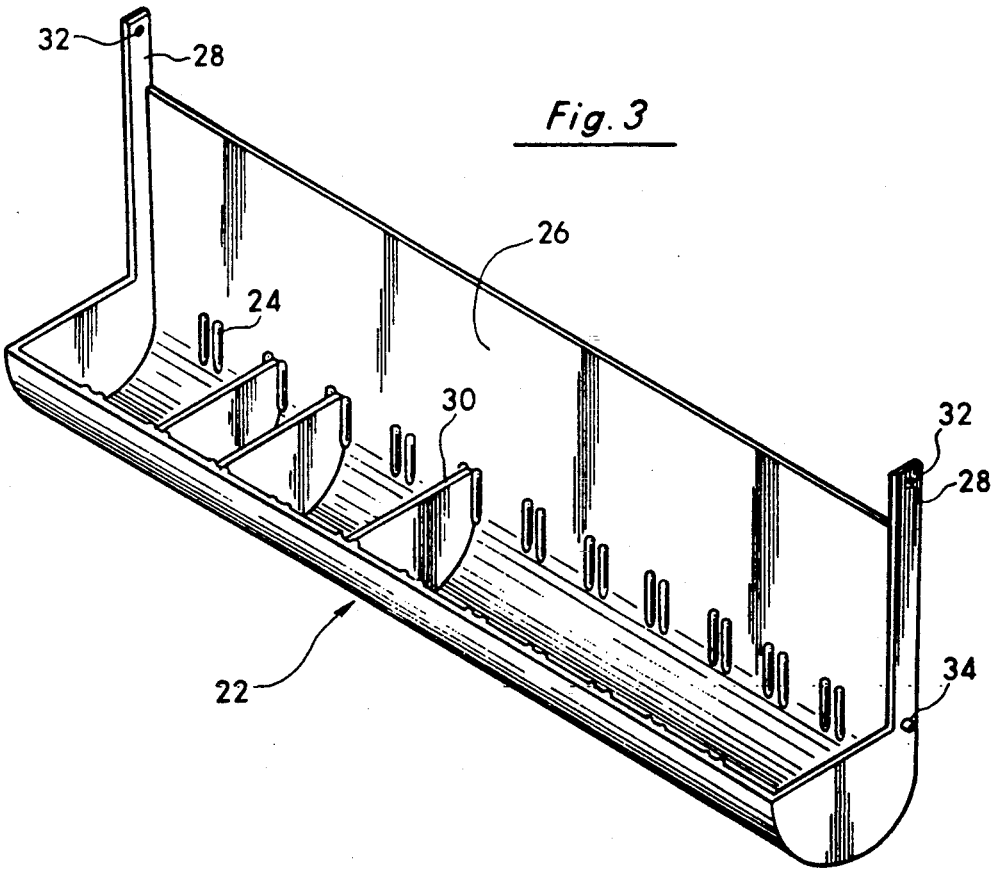
FIG. 3 is a perspective view of a single tray assembly, including a number of dividers used to define a plurality of compartments within the tray.
Figure 5:
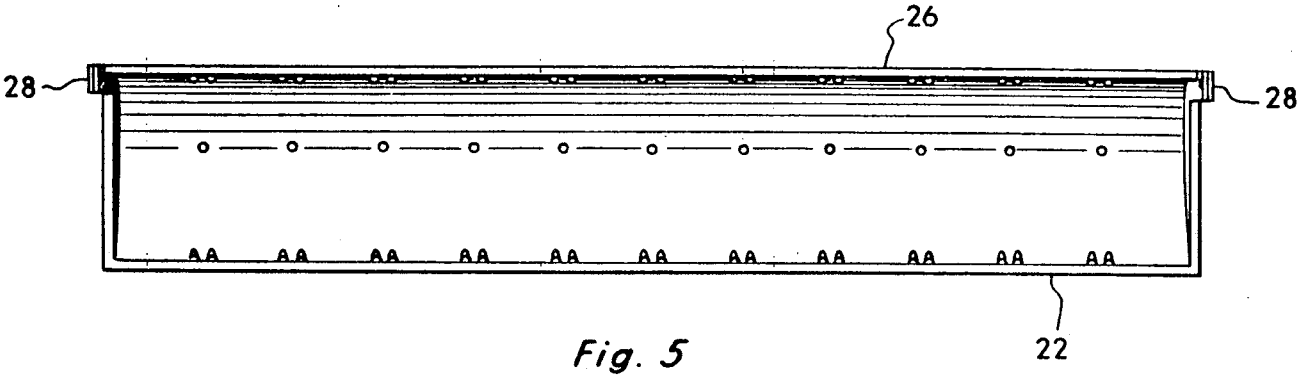
FIG. 5 is a top view of a tray assembly corresponding to FIG. 4.
Figure 4:
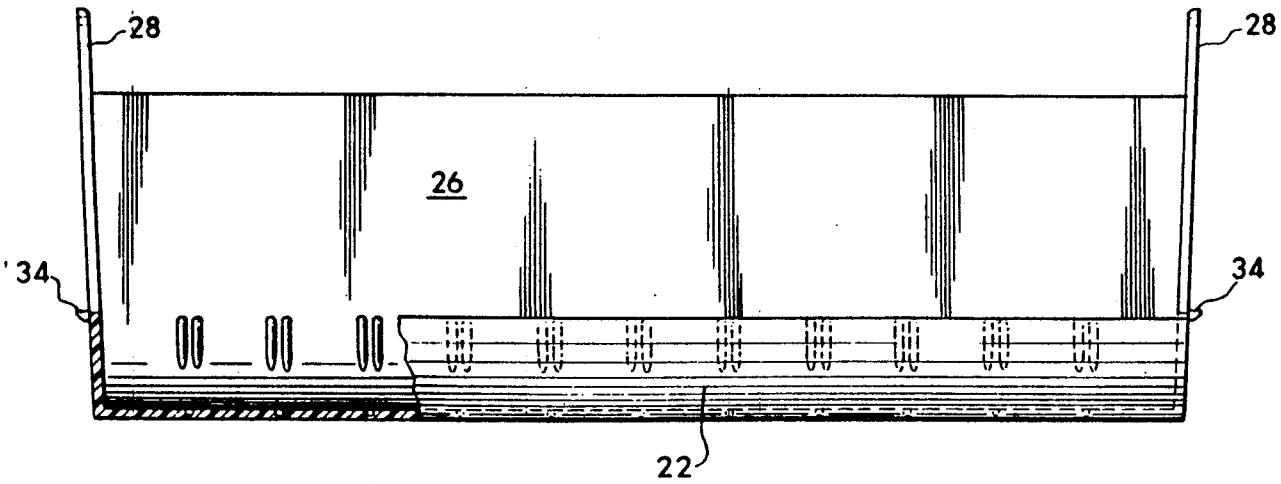
FIG. 4 is a front view of a tray assembly.
Figure 6:
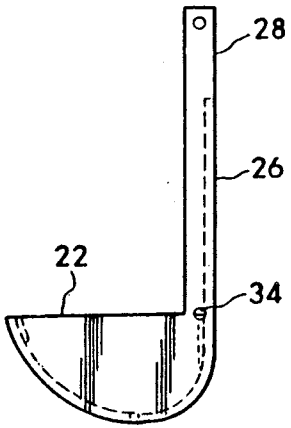
FIG. 6 an end view of a tray assembly corresponding FIG. 4.

FIG. 3 is a perspective view of one tray assembly 20 with a number of removable dividers 30 separating the tray 22 into individualized compartments. FIGS. 4 through 6 show additional views of the tray assembly. When the unit is assembled, the tray 22 is suspended in a generally horizontal orientation. The bottom of the tray is rounded so that items can be readily placed in and picked out of the tray.

In the embodiment shown in the figures, two edge members 24 extend upward from the lateral edges of the tray. The edge members can also extend laterally outward to a slight degree with respect to the ends of the tray 22. A back member 26 extends in a vertical plane upward from the rear edge of the tray between the edge members 24. These members help provide rigidity and structural integrity for the tray assembly. The vertical height of the back member 26 is fixed so that the upper edge of the back member will abut the bottom edge of the tray assembly above when the unit is assembled.

Two connecting arms 28 extend upward and laterally outward from the upper ends of the edge members. As previously mentioned, a pair of recessed indentations 32 on these connecting arms 28 are adapted to removably attach to the pins 12 of the head piece or to the pins 34 of the tray assembly immediately above. It should be noted that these recessed indentations 32 can either extend partially through the connecting arms 28, or extend entirely through the connecting arms as holes.

The entire tray assembly 20, with the exception of the removable dividers 30, can be molded in one piece from a rigid plastic material. However, the material selected should have sufficient elasticity to allow the connecting arms to be temporarily spread farther apart to a slight degree, to snap over the pins of the tray assembly or headpiece immediately above. Styrene has been found to be a suitable material for this purpose.

Finally, a pair of pins 34 extend laterally outward from opposite lateral edges of the tray 22, to provide means for attaching the next tray assembly to be suspended below. The spacing between these pins 34 on each tray assembly 20 is substantially equal to the spacing between the pins 12 on the headpiece to ensure interchangeability of the unit components.

Figure 7:
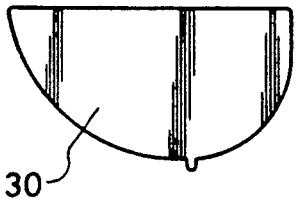
FIG. 7 a side view of a divider used to separate the tray into individual compartments.
Figure 8:
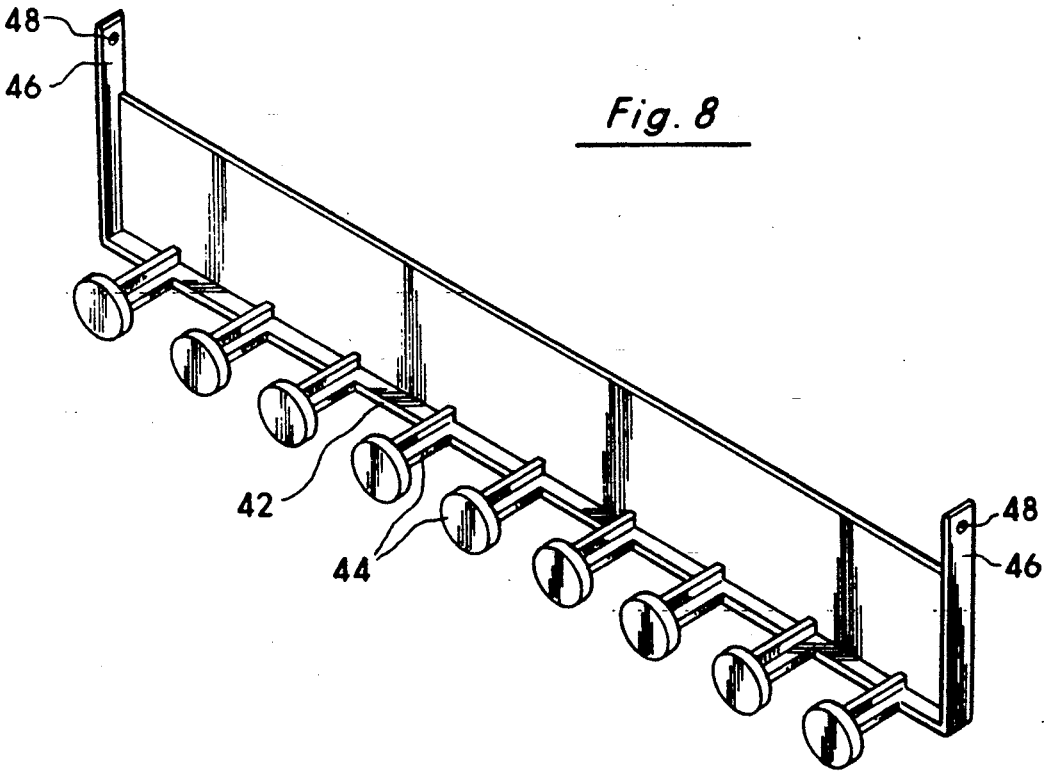
FIG. 8 is a perspective view of the hanger assembly that can be attached to the unit below the bottom tray assembly.
Figure 11:
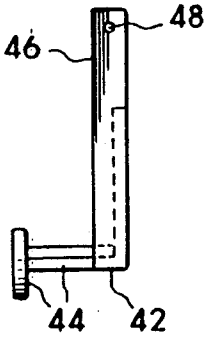
FIG. 11 is an end view of the hanger assembly, corresponding to FIG. 9.
Figure 10:
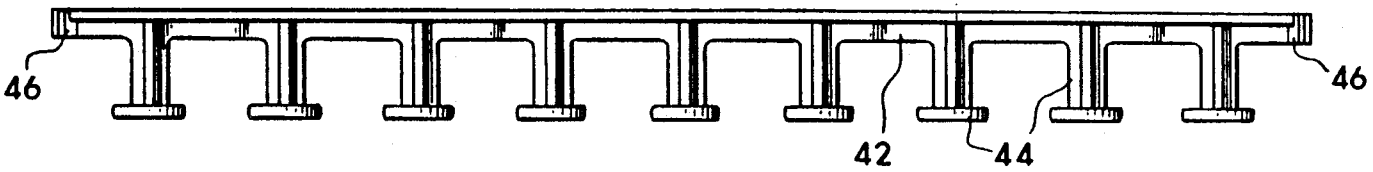
FIG. 10 is a top view of the hanger assembly, corresponding to FIG. 9.
Figure 9:
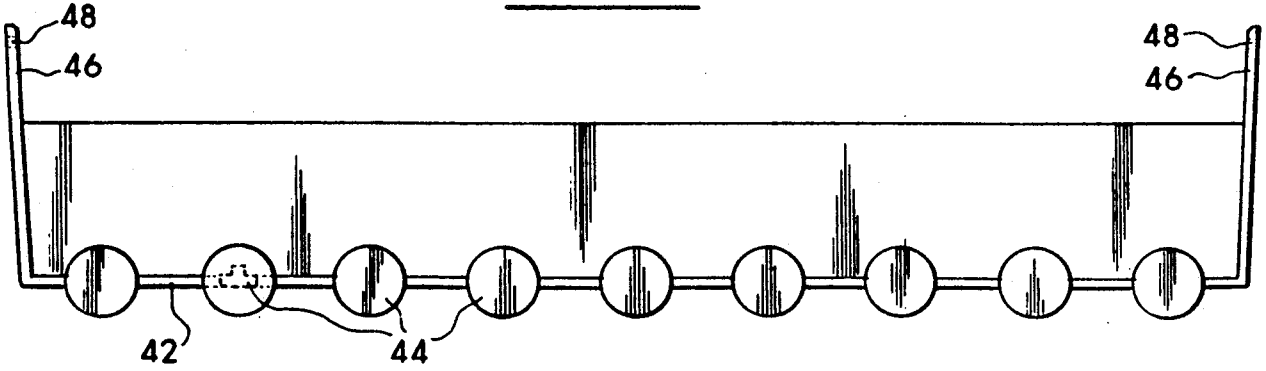
FIG. 9 is a front view of the hanger assembly.

FIG. 7 shows one of the removable dividers 30 used to partition the tray 22 into individualized compartments. A number of shallow slots molded into the wall of the tray serve to guide insertion of dividers at selected points along the length of the tray.

FIGS. 8 through 11 show a hanger assembly 40 that can be suspended below the bottom tray assembly to provide pegs to hang necklaces, bracelets, rings, or the like. The hanger assembly consists of a horizontal frame 42 with a number of forward-extending members 44, such as pegs or hooks, spaced along its length. Two connecting arms 46 extend upward from the frame 42. Recessed indentations 48 on each connecting arm are adapted to removably attach the hanger assembly 40 to the tray assembly 20 immediately above.

In an alternative embodiment of the present invention, the relative locations of the holes and recessed indentations on each component are reversed. In other words, the connecting arms of each tray assembly have a pair of pins extending medially inward from their respective medial surfaces, which attach to a pair of recessed indentations in the lateral edges of the tray assembly or headpiece directly above.

Alternative, other support means could be used to attach together components of the unit in place of the pin/indentation method described above. A few possible alternatives include hook-and-eye attachments, adhesives, velcro, clips, and a wide variety of temporary or permanent fasteners.

The above disclosure sets forth a number of embodiments of the present invention. Other arrangements or embodiments, not precisely set forth, could be practiced under the teachings of the present invention and as set forth in the following claims.

I claim:

1. A storage tray assembly comprising:

(a) wall attachment means secured to a vertical surface, having two support means spaced a predetermined horizontal distance apart;

(b) a plurality of tray assemblies suspended in series from said support means, each tray assembly having:

(i) a horizontal tray having a rear edge, a front edge, and two lateral edges;

(ii) two unitary connecting members each attached to one of said lateral edges, extending upward and laterally outward from said lateral edges, adapted to removably attach to the support means of the wall attachment means or to the tray assembly immediately above; and (iii) support means attached to both of said lateral edges of the tray, the horizontal spacing between such support means being substantially equal to the spacing between the support means of said wall attachment means; and (c) a hanger assembly suspended from the bottom tray assembly, said hanger assembly having a horizontal frame, a number of hanger members spaced along the length of said frame and extending forward from said frame, a connecting member attached to said frame extending upward and adapted to removably attach to the support means of the tray assembly immediately above.

2. A storage tray assembly comprising:

(a) a headpiece secured to a wall, having two lateral edges, with support means attached to both of said lateral edges;

(b) at least one tray assembly suspended in series from said support means of the headpiece, each tray assembly having:

(i) a horizontal tray having a rear edge, a front edge, and two lateral edges;

(ii) two unitary connecting members each attached to one of said lateral edges, extending upward and laterally outward from said lateral edges, adapted to removably attach to the support means of said headpiece or the tray assembly immediately above; and (iii) support means attached to both of said lateral edges of the tray, the horizontal spacing between such support means being substantially equal to the spacing between the support means of said headpiece; and (c) a hanger assembly suspended from the bottom tray assembly, said hanger assembly having a horizontal frame, a number of hanger members spaced along the length of said frame and extending forward from said frame, a connecting member attached to said frame extending upward and adapted to removably attach to the support means of the tray assembly immediately above.

* * * * *